US006778047B1

(12) United States Patent
Zschau

(10) Patent No.: US 6,778,047 B1
(45) Date of Patent: Aug. 17, 2004

(54) RELAY WITH A COUPLING ELEMENT

(75) Inventor: Henning Zschau, Zimmern o.R. (DE)

(73) Assignee: Hengstler GmbH, Wehingen (DE)

( * ) Notice: Subject to any disclaimer, the term of this patent is extended or adjusted under 35 U.S.C. 154(b) by 0 days.

(21) Appl. No.: 09/831,223

(22) PCT Filed: Oct. 28, 1999

(86) PCT No.: PCT/EP99/08177

§ 371 (c)(1),
(2), (4) Date: Jul. 19, 2001

(87) PCT Pub. No.: WO00/28563

PCT Pub. Date: May 18, 2000

(30) Foreign Application Priority Data

Nov. 9, 1998 (DE) ..... 198 51 507

(51) Int. Cl.[7] ..... H01H 67/02
(52) U.S. Cl. ..... 335/129; 335/130
(58) Field of Search ..... 335/78–86, 202, 335/124, 128–131; 355/159–164; 200/50.01–50.02, 50.04, 50.08; 536/159–161

(56) References Cited

U.S. PATENT DOCUMENTS 2,863,020 A 2/1958 Braumann
3,845,460 A 10/1974 Fujita et al.
4,947,146 A * 8/1990 Ichimura et al. ..... 335/131
5,081,436 A * 1/1992 Nishi et al. ..... 335/83
5,103,199 A 4/1992 Ootsuka
5,805,040 A * 9/1998 Corcoran ..... 335/202
6,081,177 A * 6/2000 Fausch ..... 335/129

FOREIGN PATENT DOCUMENTS

DE 1 590 621 10/1966
DE 196 00 314 7/1997
FR 1236552 11/1960
JP 3-110734 * 3/1991 ..... 335/159

OTHER PUBLICATIONS

Search Report dated Nov. 10, 1999 for German Patent Application No. 198 51 507.3.

* cited by examiner

*Primary Examiner*—Lincoln Donovan
(74) *Attorney, Agent, or Firm*—Baker & Daniels

(57) ABSTRACT

A relay with coupling element consists of at least one spring bracket with an active and a passive contact spring. In order mechanically to couple several such relays with one another, a coupling element is provided which is pluggably connectable with the respective spring brackets of the relays in order to create a twin relay from a single relay. If, beside the mechanical coupling, an electrical coupling also is to take place, then it is provided that at least one double contact spring is present, one part of which is allocated to the one spring bracket the other part of which is allocated to the oppositely lying spring bracket, and two contact springs are connected by the coupling element over an electrically conducting connection web.

23 Claims, 4 Drawing Sheets

RELAY WITH A COUPLING ELEMENT

BACKGROUND OF THE INVENTION

The invention relates to a relay with coupling element. With such relays there is present the need to double or to triple the relay functions, in order to make a "twin relay" or a "triple relay" from a "single relay". Such a need is present, above all, in safety technology, where what is essential is that, in the event of a failure, for example in the fusing or blocking of contacts, there still always are parallel contacts present, which take over the switching function.

Another need lies in accommodating with as little as possible circuitry expenditure a plurality of relay contacts in the least possible space. Here too, it is necessary to transfer certain electric functions of the single relay to the twin relay produced from it, in order to avoid an undesired redundance. In this case it is desired, for example, that with a twin relay all the passive contact springs both of the one and also of the other spring box lie on the same electric potential. One does not want, however, to fit any faulty wiring on a switching plate, which fulfills this requirement, but the contact springs should be directly electrically connected with one another.

Underlying the invention therefore, is the problem of further developing a relay of the type mentioned at the outset, in such manner that without circuitry expenditure it can be developed into a twin relay or a triple relay.

SUMMARY OF THE INVENTION

For the solution of the problem posed, the relay is characterized by the technical teaching of claim 1.

An essential feature is that according to the invention a coupling element is provided, which mechanically couples several spring brackets with one another. In this manner, a simple relay can be rapidly developed, over the connection and by means of a coupling element, into a multiple relay, such as a twin relay or a triple relay, for example.

The rapid mechanical connecting by means of a coupling element, therefore, is claimed as an essential feature of the present invention.

In a further development of the invention, it is provided that the coupling element simultaneously also carries in itself the electrical through-connection between the spring brackets, so that, therefore, an externally lying circuitry expenditure is avoided (for example over a switching plate on which the relays are seated with their connecting points), and that with the aid of the mechanical coupling of the coupling element, also simultaneously, the electrical coupling of the spring brackets to be connected is established. In a preferred further development of the invention, it is provided here that the electrical coupling of the spring brackets to be connected occurs over the passive contact springs. For this purpose, it is provided that no longer individual, passive contact springs are allocated to the respective spring bracket, but that a double contact spring allocated to both spring brackets is provided, which double contact spring consists of two individual contact springs that are connected with one another by means of an electrically conducting connection web. Therewith there is present the advantage that such a double contact spring is connected first with the coupling element and that the coupling element, then, is connected with the spring brackets to be connected in such manner that the one spring of the double contact spring forms, for example, the passive contact spring of the one spring bracket, while the other spring of the double contact spring forms the other passive contact spring of the other spring bracket. Both contact springs here are on electrically equal potential by reason of their electrical connection over the connection web, which pervades the contact element.

The definition given here of active and passive contact springs must not be understood as restricting protective rights. On the contrary, instead of the here-described passive contact springs, there also lies within the scope of the invention the possibility of connecting the active contact springs electrically conductively by means of a contact element over a coupling, by the means that in each case on one side of the coupling element there is arranged the respective allocated contact spring, and the electrically conductive connection between these contact springs is brought about through a connection web which pervades the coupling element and is fastened with this.

In a preferred development of the invention it is provided that the coupling of the coupling element is constructed locking with, and again releasable from, the spring brackets to be connected.

In another development of the invention it is provided that the coupling of the coupling element with the spring brackets is made rigid. There can be used here, for example, an adhesive, a melting or some other fluid connection.

An especially compact construction is yielded if the active and passive contact springs are arranged at an angle of 90°.

For the electrical potential separation between the two spring brackets it is preferred incidentally if the coupling element consists of an insulating material and has at least one partition wall running parallel to the contact rows of the relay, on which partition wall lateral projections are molded, which engage in allocated receiving openings on the respective spring bracket.

Between the lateral projections of the partition wall, grooves are formed which are suited for the reception of the contact springs. On the other hand, after slots are arranged parallel to the lengthwise axes of the reception openings in the respective spring bracket opened toward the face side, there, the passive contact springs can be slid in.

The inventive object of the present invention is yielded not only from the object of the individual patent claims, but also from the combination of the individual patent claims among one another.

BRIEF DESCRIPTION OF THE DRAWINGS

In the following, the invention is explained in detail with the aid of drawings representing only one mode of execution. For the drawing and its description there appear further features and advantages essential to the invention.

DETAILED DESCRIPTION

Figure 1:
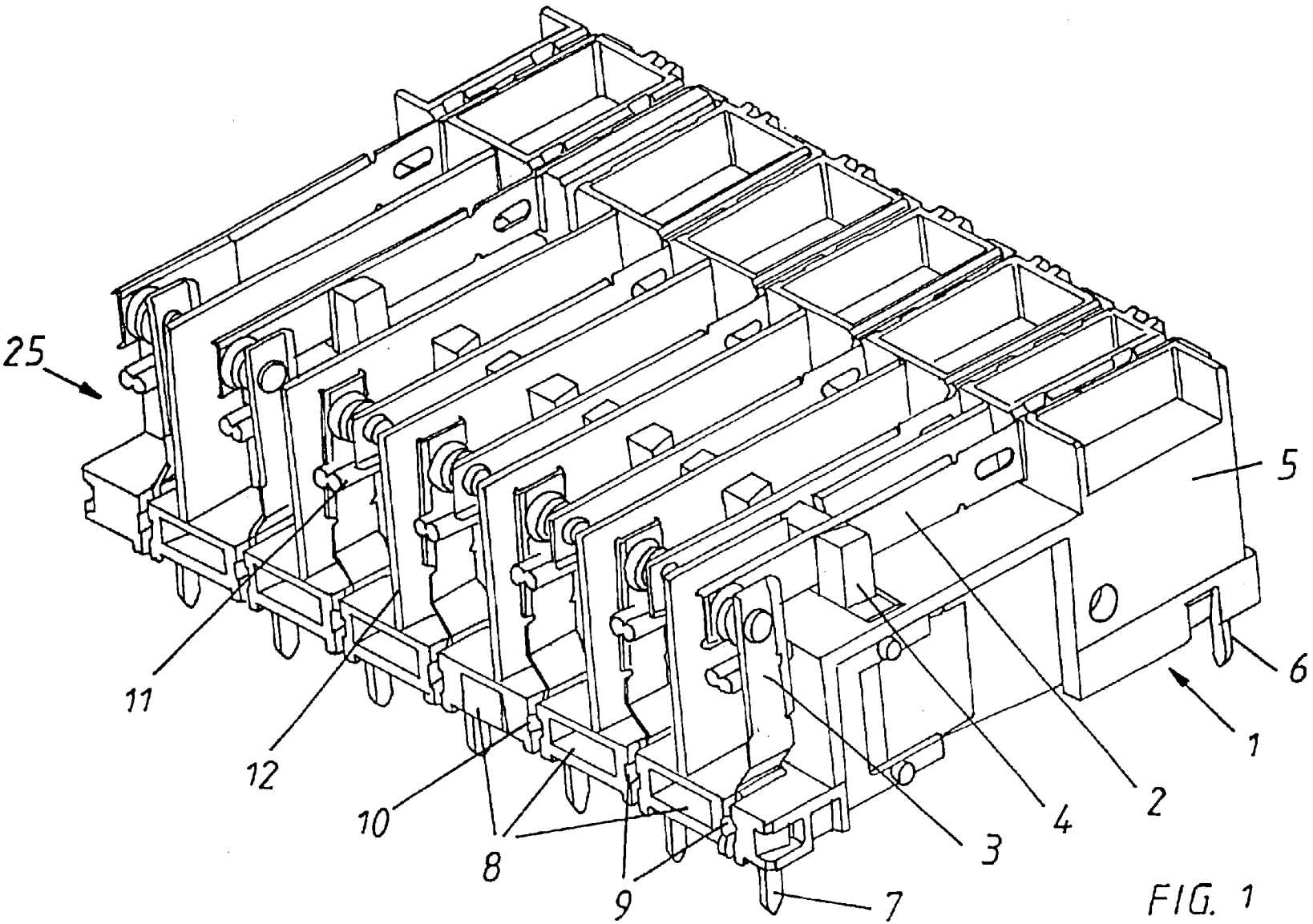
FIG. 1 shows schematically an individual relay.

The individual relay consists of a spring bracket 1, on which there is arranged the drive 5. On the spring bracket 1 there is arranged, lying, an active contact spring 2, which is actuated by an actuator 4. Standing in the spring bracket there is arranged in each case a passive contact spring 3. All the contact sets are arranged in a contact series 25, the contact sets being separated from one another by allocated partition walls 12.

The respective passive contact spring rests here on a housing-fast support web 11. The drive system is contacted over a connecting pin 6 (led out downward), just as the active and passive contact springs 2 are led out downward through allocated connecting pins 7.

It is important, now, that the one face wall of the spring bracket 1 has a face-side, open, receiving openings 8, which are intended for the engagement of allocated projections 16 of a coupling element 14. Between the receiving openings 8 there are formed slots 9, into which the contact springs 3 are thrust from the face side and are supported there. The support occurs here by multiply offset grooves 10, so that there is ensured a favorable, stable support of the respective contact spring 3.

Figure 2:
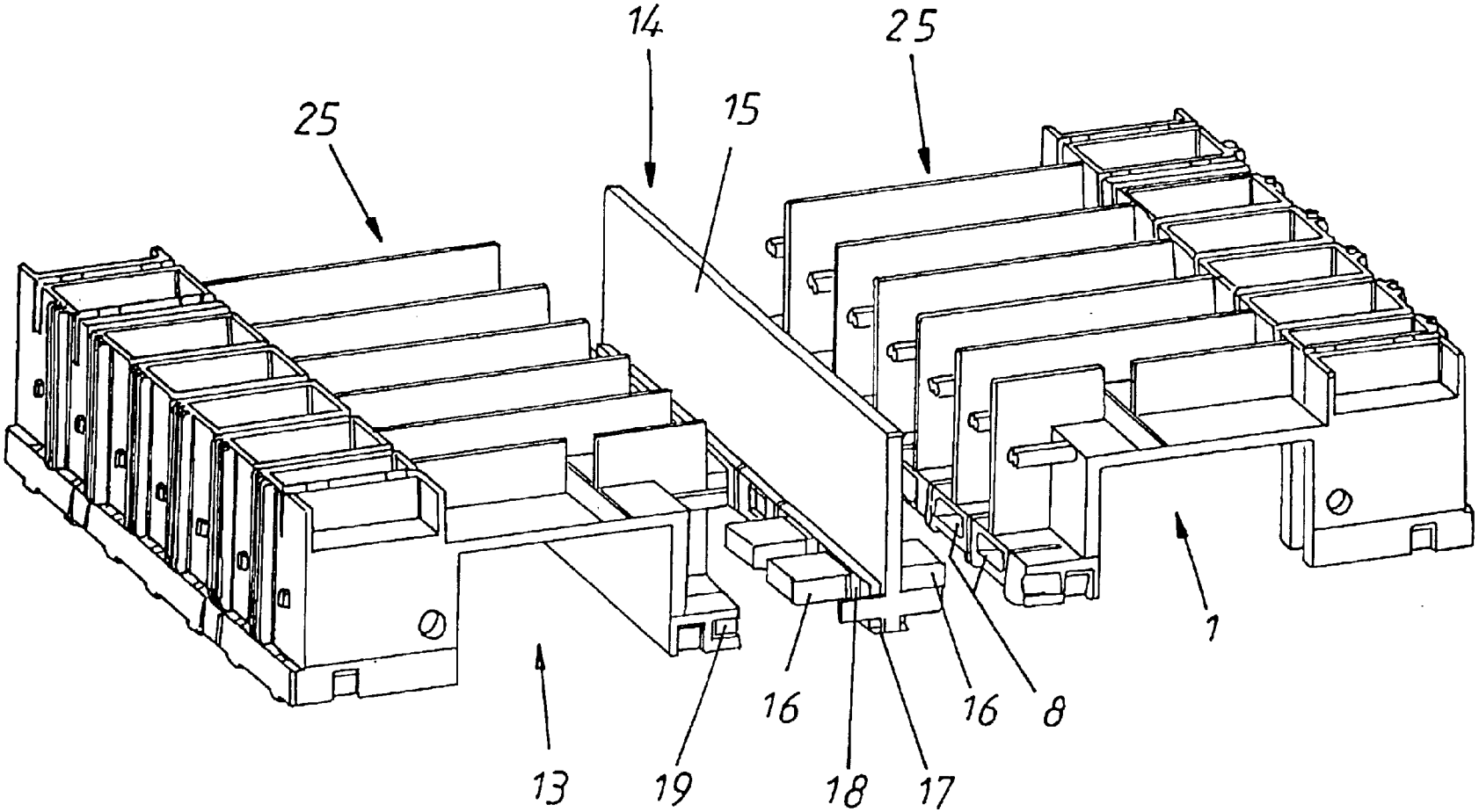
FIG. 2 shows schematically the coupling of two individual relays with a coupling element.
Figure 3:
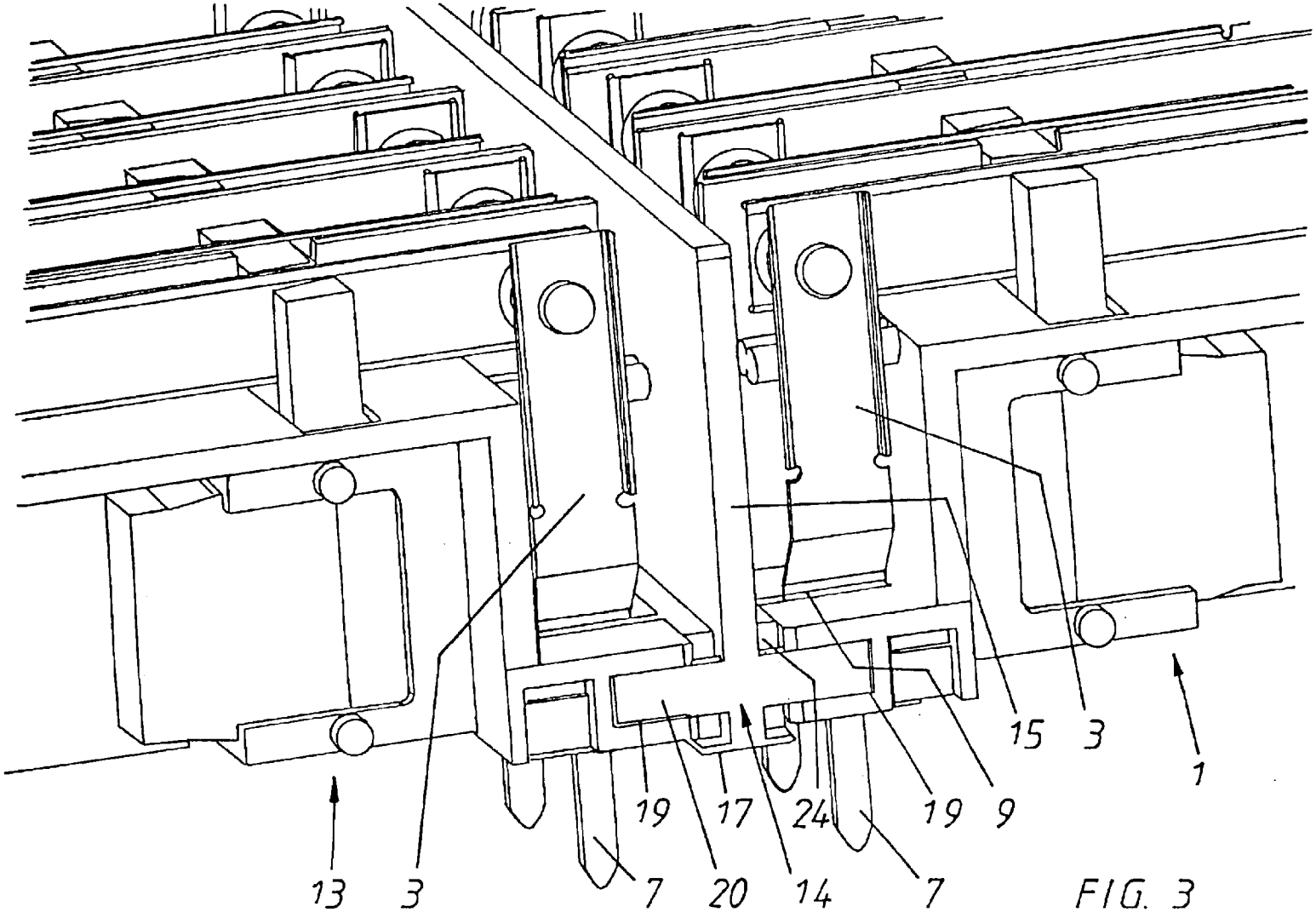
FIG. 3 shows the assembled state of the twin relay
Figure 4:
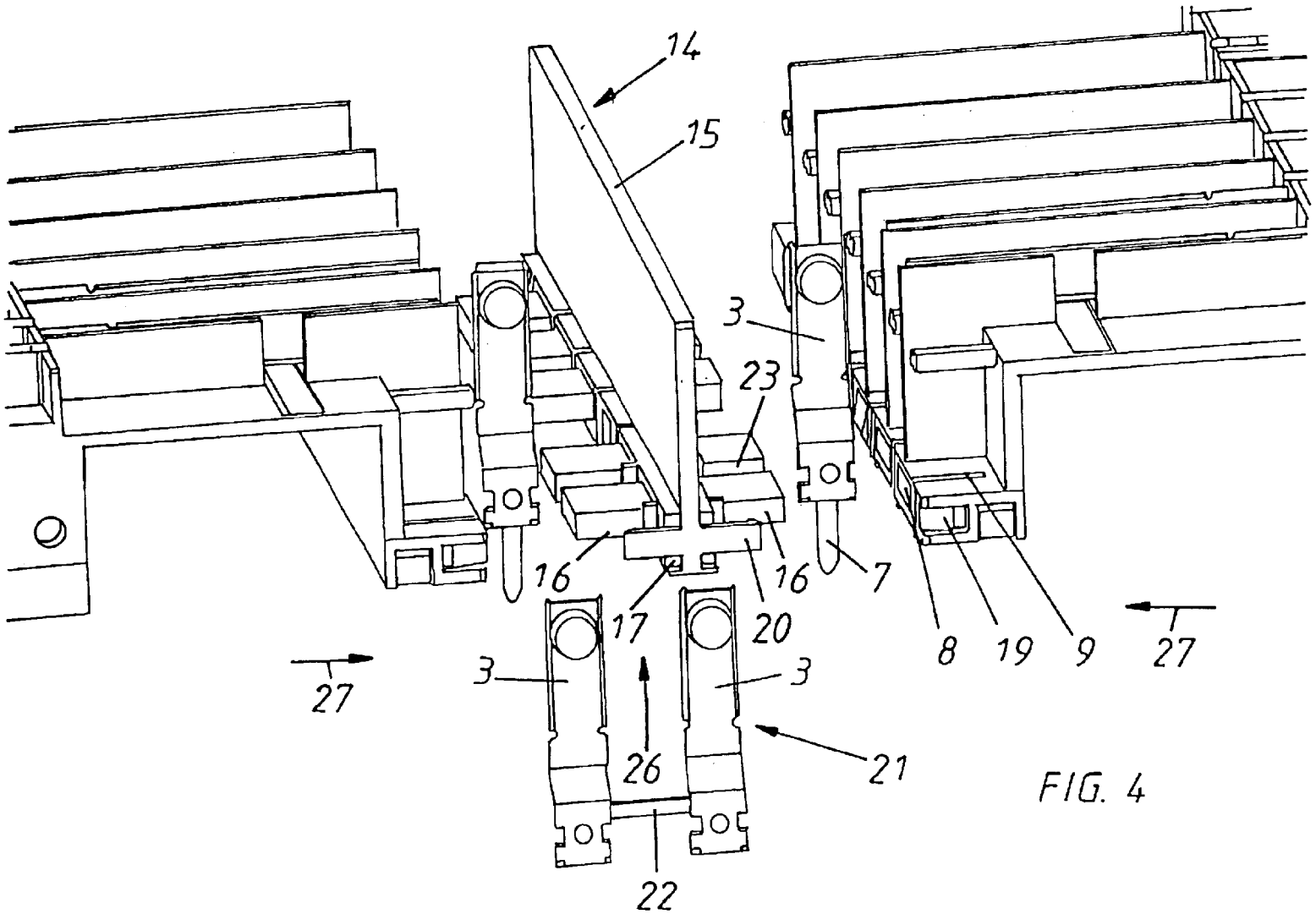
FIG. 4 is an exploded view in comparison to FIG. 3, with representation of different contact springs.

With the aid of the coupling element 14 there is now to be created from the single relay according to FIG. 1, a twin relay according to FIGS. 2 to 4. For this, there is provided the coupling element 14 which essentially consists of a plastic part, which has a middle partition wall 15, the height of which about corresponds to the height of the spring bracket 1, 13. From the partition wall 12 there extend in each case in opposite directions the projections 16, which are intended for engagement into the allocated receiving openings 8 of the spring brackets 1, 13 to be connected.

The partition wall 15 has in its lower zone, an about T-shaped form with a cross-carrier 20 formed on the partition wall 15, on the underside of which cross-carrier supporting ribs 17 are arranged. In this manner there is achieved a favorable, rigid, mechanical connection between the spring brackets 1, 13 to be connected, for according to the representation in FIG. 3 the cross-carrier 20 engages into an allocated, one-side open catch receptacle 19 and is fixed there with allocated snap-in means 18.

In addition a material-flow connection of the coupling element with the respective spring bracket 1, 13 can occur by the means that the parts touching and engaging into one another are cemented with adhesive.

Disposed laterally on the partition wall 15, there are further arranged spacer ribs 24, which are space-maintaining for the allocated face sides of the receiving openings 8. On these spacer ribs 24 there come to lie, therefore, the face sides of the receiving openings 8 of the respective spring brackets 1, 13.

If now there is to occur also an electrical connection over the mechanical connection of such spring brackets 1, 13, then, according to the invention, a double contact spring 21 is provided, such as is represented in FIG. 4. It consists of the earlier-mentioned passive contact springs 3, which are joined with one another by means of an electrically conductive connecting web 22.

For the assembling, therefore the double contact spring 21 is thrust upward in arrow direction 26 against the underside of the coupling element 14, so that the connecting web comes into engagement with the grooves 23, between the projections 16.

Now, the right-side spring bracket 1 is thrust in arrow direction 27 against the coupling element 14, so that the right contact spring 3 is slid into the slot 9 on the spring bracket 1, and simultaneously the projections 16 engage into the receiving openings 8 on the spring bracket.

In an analogous manner there takes place the connection with the oppositely lying spring bracket 13.

From this it is evident that now, besides the mechanical coupling of the spring brackets 1, 13, there has also occurred an electric through-connection over the contact springs 3,3, electrically connected with one another. Hereby a substantial expenditure in circuitry can be spared, for it is no longer necessary to bring about the through-connection of the contact springs with the aid of the connection pins 7 over a switching plate (not shown).

Legends for the Figures

1. Spring bracket
2. Contact spring (active)
3. Contact spring (passive)
4. Actuating/actuator
5. Drive
6. Connecting pins
7. Connecting pins
8. Receiving opening
9. Slot
10. Groove
11. Support web
12. Partition wall
13. Spring bracket
14. Coupling element
15. Partition wall
16. Projection
17. Snap-in means
18. Catch receptacle
19. Catch receptacle.
20. Cross carrier
21. Double contact spring
22. Connecting web
23. Groove
24. Spacer rib
25. Contact series/row
26. Arrow direction
27. Arrow direction

What is claimed is:

1. Relay with a coupling element, comprising: a first spring bracket, a first plurality of contact spring pairs, each of the first plurality of contact spring pairs including an active contact spring disposed on the first spring bracket which cooperates with a passive contact spring positioned on the coupling element, wherein associated with the first plurality of contact spring pairs is a drive disposed on the first spring bracket and which acts over an actuator on at least one active contact spring which cooperates with at least one passive contact spring of the first plurality of contact spring pairs at least one of the active and passive contact springs of the first plurality of contact spring pairs being electrically contactable through a connecting pin; characterized in that the relay is mechanically connectable with at least one further relay wherein the further relay includes a second spring bracket and defines a second plurality of contact spring pairs, each of the second plurality of contact spring pairs including an active contact spring disposed on the second spring bracket which cooperates with a passive contact spring positioned on the coupling element, wherein associated with the second plurality of contact spring pairs is a second drive disposed on the second spring bracket at least one of the active and passive contact springs of the second plurality of contact spring pairs being electrically contactable through a second connecting pin, and wherein the coupling element is constructed as a separate component engagable with the spring brackets of the respective relays to thereby provide the mechanical connection between the respective relays, electric connecting pins of the contact springs of the first and second plurality of contact spring pairs of the respective relays being disposed proximate the coupling element, and further characterized in that the passive contact springs of the first plurality of contact spring pairs are aligned with the passive contact springs of the second plurality of contact spring pairs, each passive contact spring of the first plurality of contact spring pairs positioned on the coupling element opposite one of the passive contact springs of the second plurality of contact spring pairs wherein the coupled relays lie in mirror-image symmetry relative to the coupling element.

2. Relay according to claim 1, characterized in that the active and/or passive contact springs of the spring brackets of said relays are also electrically coupled with one another across the coupling element.

3. Relay according to claim 1, characterized in that the coupling element is releasably coupled.

4. Relay according to claim 1, characterized in that the coupling element is non-releasably coupled.

5. Relay according to claim 4, characterized in that the coupling element comprises an insulating material and has at least one partition wall insulatingly separating the respective contact springs of the relays when the relays are coupled, said partition wall having lateral projections molded thereon which are engagable within corresponding receiving openings on the respective spring brackets of the relays.

6. Relay according to claim 5, characterized in that between the lateral projections of the partition wall grooves are formed, which grooves are adapted for the reception of said contact springs.

7. Relay according to claim 1, characterized in that the receiving openings of the respective spring brackets of the relays define lengthwise axes and the spring brackets further define outwardly opening slots disposed parallel to the lengthwise axes, the passive contact springs being disposed within the slots.

8. Relay according to claim 7, characterized in that for the electrical connection of the passive contact springs of the spring brackets of the two relays, at least one double contact spring is slidable into grooves of the coupling element.

9. Relay according to claim 8, characterized in that the at least one double contact spring is adapted to be connected with the coupling element prior to the coupling element being plugged together with the respective spring brackets of the relays.

10. Relay according to claim 9, characterized in that the active and passive contact springs are arranged at an angle of 90° to one another.

11. Relay according to claim 2, characterized in that the coupling element is releasably coupled.

12. Relay according to claim 2, characterized in that the coupling element is non-releasably coupled.

13. Relay according to claim 1, characterized in that the coupling element comprises an insulating material and has at least one partition wall insulatingly separating the respective contact springs of the relays, said partition wall having lateral projections molded thereon which are engagable within corresponding receiving openings on the respective spring brackets of the relays.

14. Relay according to claim 2, characterized in that the coupling element comprises an insulating material and has at least one partition wall insulatingly separating the respective contact springs of the relays when the relays are coupled, said partition wall having lateral projections molded thereon which are engagable within corresponding receiving openings on the respective spring brackets of the relays.

15. Relay according to claim 3, characterized in that the coupling element comprises an insulating material and has at least one partition wall insulatingly separating the respective contact springs of the relays when the relays are coupled, said partition wall having lateral projections molded thereon which are engagable within corresponding receiving openings on the respective spring brackets of the relays.

16. Relay according to claim 6, charaterized in that for the electrical connection of the passive contact springs of the spring brackets of the two relays, at least one double contact spring is slidable into grooves of the coupling element.

17. Relay according to claim 1, characterized in that the active and passive contact springs are arranged at an angle of 90° to one another.

18. Relay according to claim 2, characterized in that the active and passive contact springs are arranged at an angle of 90° to one another.

19. Relay assembly with a coupling element, comprising: at least two relays, each relay having at least one spring bracket, a plurality of contact spring pairs associated with each relay, each of the plurality of contact spring pairs including an active contact spring disposed on the spring bracket of one of the relays and a passive contact spring positioned on the coupling element, a drive disposed on each of the spring brackets each of the drives acting over an actuator on at least one active contact spring which cooperates with at least one passive contact spring at least one of the active and passive contact springs of each of the pluralities of contact spring pairs being electrically contactable through a connecting pin characterized in that the at least two relays are mechanically connectable, a coupling element constructed as a separate component engagable with the spring brackets of the respective relays to thereby provide the mechanical connection between the respective relays, the electric connecting pins of the respective relays being disposed proximate the coupling element, and further characterized in that each of the passive contact springs of the plurality of contact spring pairs of one relay is aligned with and positioned on the coupling element opposite one of the passive contact springs of the plurality of contact spring pairs of the other relay wherein the at least two coupled relays lie in mirror-image symmetry relative to the coupling element and wherein the coupling element is releasably coupled.

20. Relay assembly with a coupling element, comprising: at least two relays, each relay having at least one spring bracket, a plurality of contact spring pairs associated with each relay, each of the plurality of contact spring pairs including an active contact spring disposed on the spring bracket of one of the relays and a passive contact spring positioned on the coupling element, a drive disposed on each of the spring brackets, each of the drives acting over an actuator on at least one active contact spring which cooperates with at least one passive contact spring, at least one of the active and passive contact springs of each of the pluralities of contact spring pairs being electrically contactable through a connecting pin; characterized in that the at least two relays are mechanically couplable, a coupling element constructed as a separate component engagable with the spring brackets of the respective relays, the electric connecting pins of the contact springs of the respective relays being disposed proximate the coupling element, and further characterized in that each of the passive contact springs of the plurality of contact spring pairs of one relay is aligned with and positioned on the coupling element opposite one of the passive contact springs of the plurality of contact spring pairs of the other relay wherein the at least two coupled relays lie in mirror-image symmetry relative to the coupling element and wherein the plurality of contact spring pairs of each of the at least two relays are also electrically coupled with one another across the coupling element.

21. The relay assembly with coupling element of claim 20 wherein the coupling element electrically couples the contact springs of the at least two coupled relays to define a serial circuit.

22. Relay with coupling element, comprising; a first spring bracket, a first plurality of contact spring pairs, each of the first plurality of contact string pairs including an active contact spring disposed on the first spring bracket which cooperates with a passive contact spring positioned on the coupling element, wherein associated with the first plurality of contact spring pairs is a drive disposed on the first spring bracket and which acts over an actuator on at least one active contact spring which cooperates with at least one passive contact spring of the first plurality of contact spring pairs, at least one of the active and passive contact springs of the first plurality of contact spring pairs being electrically contactable through a connecting pin; characterized in that the relay is mechanically couplable with at least one further relay wherein the further relay includes a second spring bracket and defines a second plurality of contact spring pairs, each of the second plurality of contact spring pairs including an active contact spring disposed on the second spring bracket which cooperates with a passive contact spring positioned on the coupling element, wherein associated with the second plurality of contact spring pairs is a second drive disposed on the second spring bracket, at least one of the active and passive contact springs of the second plurality of contact spring pairs being electrically connectable through a connecting pin, and wherein the coupling element is constructed as a separate component engagable with the spring brackets of the respective relays, the electric connecting pins of the contact springs of the respective relays being disposed proximate the coupling element, and further characterized in that each of the passive contact spring of the first and second plurality of contact spring pairs of the coupled relays are aligned with each passive contact spring of the first plurality of contact spring pairs positioned on the coupling element opposite one of the passive contact springs of the second plurality of contact spring pairs wherein the at least two coupled relays lie in mirror-image symmetry relative to the coupling element and wherein said coupling element includes at least one groove and at least one multiple contact spring slidably mounted in the groove, the multiple contact spring comprising and electrically coupling one of the passive contact springs of the first plurality of contact spring pairs and an aligned one of the passive contact spring of the second plurality of contact spring pairs.

23. The relay with coupling element of claim 22 wherein the coupling element electrically couples the contact springs of the at least two coupled relays to define a serial circuit.

* * * * *

UNITED STATES PATENT AND TRADEMARK OFFICE

CERTIFICATE OF CORRECTION

PATENT NO. : 6,778,047 B1
DATED : August 17, 2004
INVENTOR(S) : Henning Zschau

It is certified that error appears in the above-identified patent and that said Letters Patent is hereby corrected as shown below:

Title page,
Item [57], ABSTRACT,
Line 11, after "and" insert -- the --.

Column 6,
Line 5, delete "charaterized" and insert -- characterized --.
Line 15, delete Claim 19 and insert the corrected Claim 19:

-- 19. Relay assembly with a coupling element, comprising: at least two relays, each relay having at least one spring bracket, a plurality of contact spring pairs associated with each relay, each of the plurality of contact spring pairs including an active contact spring disposed on the spring bracket of one of the relays and a passive contact spring positioned on the coupling element, a drive disposed on each of the spring brackets, each of the drives acting over an actuator on at least one active contact spring which cooperates with at least one passive contact spring, at least one of the active and passive contact springs of each of the pluralities of contact spring pairs being electrically contactable through a connecting pin; characterized in that the at least two relays are mechanically connectable, a coupling element constructed as a separate component engagable with the spring brackets of the respective relays to thereby provide the mechanical connection between the respective relays, the electric connecting pins of the respective relays being disposed proximate the coupling element, and further characterized in that each of the passive contact springs of the plurality of contact spring pairs of one relay is aligned with and positioned on the coupling element opposite one of the passive contact springs of the plurality of contact spring pairs of the other relay wherein the at least two coupled relays lie in mirror-image symmetry relative to the coupling element and wherein the coupling element is releasably coupled.--

Column 7,
Line 5, delete Claim 22 and insert the correct Claim 22:

--22. Relay with a coupling element, comprising: a first spring bracket, a first plurality of contact spring pairs, each of the first plurality of contact spring pairs including an active contact spring disposed on the first spring bracket which cooperates with a passive contact spring positioned on the coupling element, wherein associated with the first plurality of contact spring pairs is a drive disposed on the first spring bracket and which acts over an actuator on at least one active contact spring which cooperates with at least one passive contact spring of the first plurality of contact spring pairs, at least one of the active and passive contact springs of the first plurality of contact spring pairs being electrically contactable through a connecting pin;

UNITED STATES PATENT AND TRADEMARK OFFICE

CERTIFICATE OF CORRECTION

PATENT NO. : 6,778,047 B1
DATED : August 17, 2004
INVENTOR(S) : Henning Zschau

It is certified that error appears in the above-identified patent and that said Letters Patent is hereby corrected as shown below:

Column 7 (cont'd), characterized in that the relay is mechanically couplable with at least one further relay wherein the further relay includes a second spring bracket and defines a second plurality of contact spring pairs, each of the second plurality of contact spring pairs including an active contact spring disposed on the second spring bracket which cooperates with a passive contact spring positioned on the coupling element, wherein associated with the second plurality of contact spring pairs is a second drive disposed on the second spring bracket, at least one of the active and passive contact springs of the second plurality of contact spring pairs being electrically connectable through a connecting pin, and wherein the coupling element is constructed as a separate component engagable with the spring brackets of the respective relays, the electric connecting pins of the contact springs of the respective relays being disposed proximate the coupling element, and further characterized in that each of the passive contact springs of the first and second plurality of contact spring pairs of the coupled relays are aligned with each passive contact spring of the first plurality of contact spring pairs positioned on the coupling element opposite one of the passive contact springs of the second plurality of contact spring pairs wherein the at least two coupled relays lie in mirror-image symmetry relative to the coupling element and wherein said coupling element includes at least one groove and at least one multiple contact spring slidably mounted in the groove, the multiple contact spring comprising and electrically coupling one of the passive contact springs of the first plurality of contact spring pairs and an aligned one of the passive contact springs of the second plurality of contact spring pairs.--

Signed and Sealed this

Eighth Day of February, 2005

JON W. DUDAS
*Director of the United States Patent and Trademark Office*